US006484321B1

(12) United States Patent
Shamam

(10) Patent No.: US 6,484,321 B1
(45) Date of Patent: Nov. 26, 2002

(54) MULTI-PURPOSE PATIENT HOSPITAL GOWN

(76) Inventor: Ronnye B. Shamam, 70 E. 10th St., New York, NY (US) 10003

( * ) Notice: Subject to any disclaimer, the term of this patent is extended or adjusted under 35 U.S.C. 154(b) by 0 days.

(21) Appl. No.: 09/848,938

(22) Filed: May 4, 2001

(51) Int. Cl.[7] ..... A41D 13/00
(52) U.S. Cl. ..... 2/114; 2/69
(58) Field of Search ..... 2/114, 50, 51, 2/88, 69, 69.5, 104–106, 83, 95, 80, 85

(56) References Cited

U.S. PATENT DOCUMENTS 1,489,046 A * 4/1924 Thompson ..... 2/114
4,570,268 A * 2/1986 Freeman ..... 2/114
4,698,848 A * 10/1987 Buckley ..... 2/114
4,718,124 A * 1/1988 Sawicki et al. ..... 2/114
5,142,702 A * 9/1992 Piloian ..... 2/102
5,440,763 A * 8/1995 Shah et al. ..... 2/114
5,799,330 A * 9/1998 O'Donoghue-Kitt ..... 2/114

* cited by examiner

*Primary Examiner*—Gloria M. Hale
(74) *Attorney, Agent, or Firm*—Levisohn, Lerner, Berger & Langsam, LLP

(57) ABSTRACT

The invention relates to a closed rear gown for a patient to wear in the hospital that provides for modesty and for convenient access to the patient's body by the medical and nursing staff for patient care. The gown is provided with a front opening and closing by the patient and for opening and closing the sleeves at the top of the shoulder to provide for access to the shoulder, arms and back of the patient by the medical and nursing staff. A telemetry pocket may also be provided.

13 Claims, 4 Drawing Sheets

MULTI-PURPOSE PATIENT HOSPITAL GOWN

FIELD OF THE INVENTION

The present invention relates to a gown to be worn by a patient. More particularly, the present invention relates to a front tying gown with snap closing sleeves that would typically be provided for a patient to wear during his or her stay in a hospital.

BACKGROUND OF THE INVENTION

There are gowns in widespread use in hospitals and other medical facilities. Typically, patients staying in a hospital are provided with a gown, as patient apparel, by the hospital. The gowns commonly worn by patients staying in a hospital generally provide for opening and closing in the rear of the gown by one or more ties. These gowns have the disadvantage that the patient finds it difficult to tie and untie the gown with the ties in the rear and sometimes needs the assistance of a nurse to tie and untie the gown.

It is known to provide in a rear opening patient gown a telemetry pocket, which is usually located on or near the center chest portion of the gown. The telemetry pocket accommodates the majority of patient monitors and provides an opening through the gown for wire connections.

It is further known to provide in a rear opening patient gown steel gripper closures on the sleeves that allow for the snap opening and closure of the sleeves. Those gowns having gripper or snap closures are commonly referred to as I.V or intravenous gowns because they facilitate access to the shoulder and arm for insertion, care and removal of intravenous administrations to the patient. Additionally, some gowns use Velcro closures for the rear closing of the gown and for opening and closing the sleeve.

Gowns worn by patients, which tie and untie in the front, are generally known as examining gowns. Examining gowns that tie in the front are commonly used for certain examinations, such as mammographies and x-rays. These gowns have the disadvantage that the doctor or medical provider does not have easy access to the posterior of the patient's body, which may be necessary for certain medical examinations or procedures. Such examining gowns are not known to have a telemetry pocket or to have sleeve snap closures.

These patient gowns do not simultaneously provide for both patient modesty and patient care and examination. There is a need to provide for a gown that may be worn by a patient during his or her stay in the hospital that allows the patient to easily and conveniently dress and undress his or herself in the gown by providing for opening and closure of the gown in its front, while also providing for convenient patient care, such as, convenient access to the shoulder, arms and/or back of the patient and a pocket for holding medical devices.

SUMMARY OF THE INVENTION

The invention relates to a patient gown for improving patient modesty and simultaneously providing for convenient patient care. More specifically, the invention relates to a patient gown that opens and closes in the front, allowing the patient to dress and undress himself or herself, that further provides for a telemetry pocket and that may provide for opening and closing of the sleeves or shoulders of the gown.

Accordingly, it is an object of the invention to provide for a gown that improves patient modesty.

It is a further object of the invention to provide for a patient gown that, while improving patient modesty, allows for the carrying of telemetry equipment.

It is a further object of the invention to provide for a patient gown that while improving patient modesty allows for an opening and closing of the sleeves or shoulders of the gown to provide for better patient care.

It is a further object of this invention to provide for a patient gown that combines front opening of the gown with a telemetry pocket and opening and closing of the sleeves or shoulders of the gown for better patient care.

Other objects advantages and features of this invention will become more apparent hereinafter.

BRIEF DESCRIPTION OF THE DRAWINGS

An embodiment of a method of the present invention will now be described with reference to the accompanying drawing figures.

DETAILED DESCRIPTION OF THE PREFERRED EMBODIMENTS

Figure 1:
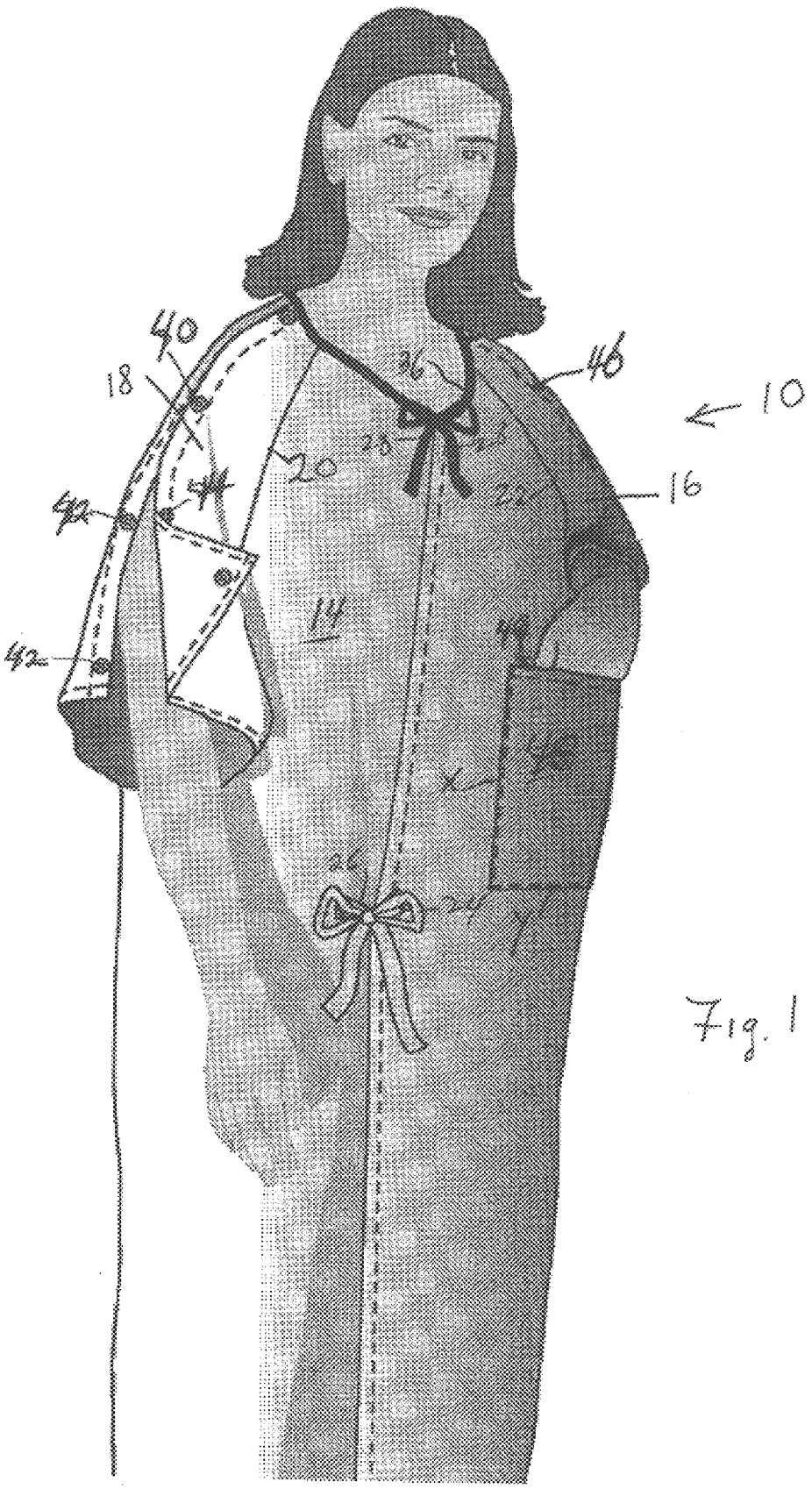
FIG. 1 is a front perspective view of an embodiment of the present invention.

Turning initially to FIG. 1, there is illustrated a front perspective view of a first embodiment of the present gown invention. The gown 10 comprises a body portion 14, a right sleeve 16 and a left sleeve 18.

Figure 3:
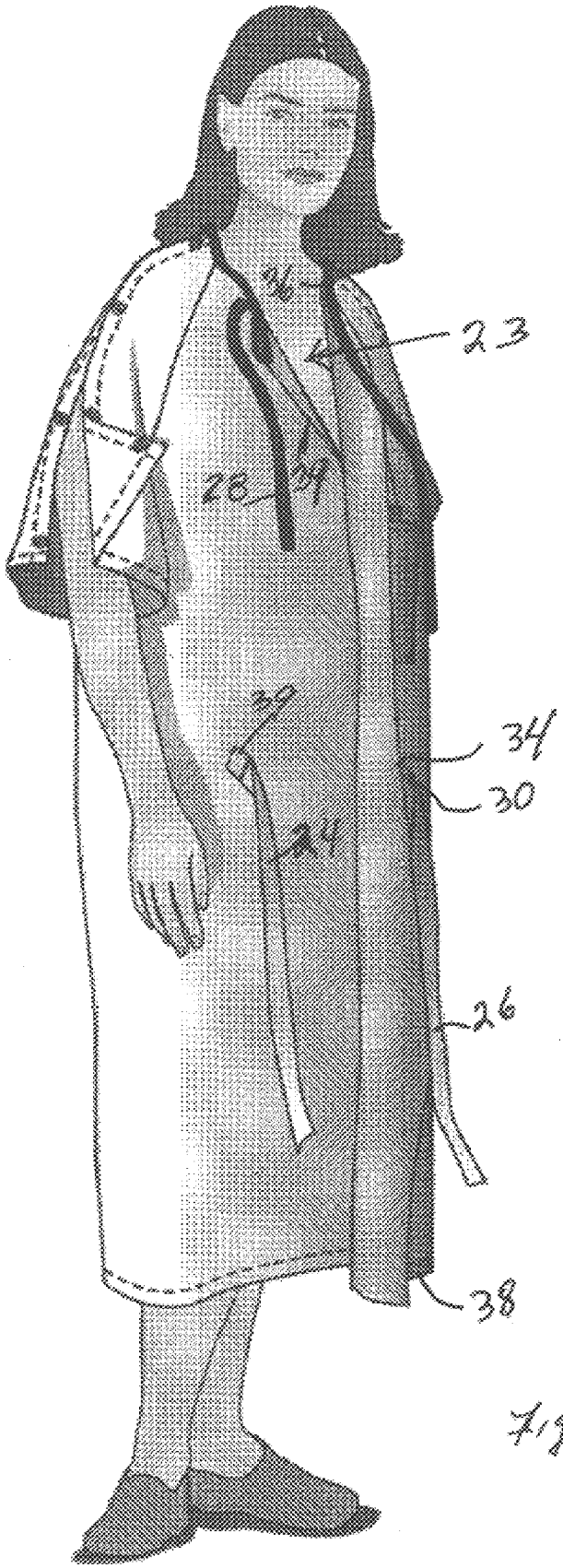
FIG. 3 is a front perspective view of the embodiment of this invention shown in FIG. 1 with the front slightly open.

The body portion 14 is sewn to the left sleeve 18 to form a seam 22. The body portion is also sewn to the right sleeve 16 to form a seam 20. The body portion 14 extends around the patient in a rear closed manner and terminates in an open front 23 (see FIG. 3) which is closed by front ties 24, 26 and 28 but may normally hang in a partially closed draped fashion when the ties are not secured together. In particular, a left lower tie 26 may be attached to the left front end of the body 14 at a location 30 between the top 36 of the left front end 34 and the bottom 38 of the left front end 34. A right lower tie 24 may be attached to the front right portion 39 of the body portion 14. Thus, when the gown is worn by a patient, the right lower tie 24 may be tied to the left lower tie 26 and an area of overlap is formed in the front of the body portion 14. Additionally a pair of upper ties 28 secures the front top of the gown.

As shown in FIG. 1, in a preferred embodiment the right sleeve is provided with a row of conventional snap closures 40 comprising a respective projection portion 42 and a receiving section 44 which secures the projection portion 42 in place. Each protection portion 42 is situated across from its counterpart receiving section 44. Thus, in use the patient may close the left sleeve by mating each projection portion 42 with its counterpart receiving section 44. In a similar manner, the left sleeve is formed symmetrically to the right sleeve. In a preferred embodiment, four snap closures 40 are provided for the right sleeve and four snap closures 46 (partially seen in FIG. 1) are provided for the left sleeve.

Alternatively, to the use of the snap closures and ties, other closures may be used, such as and without limitation, Velcro closings, zippers, buttons and other forms of tying and snap closures.

Figure 4:
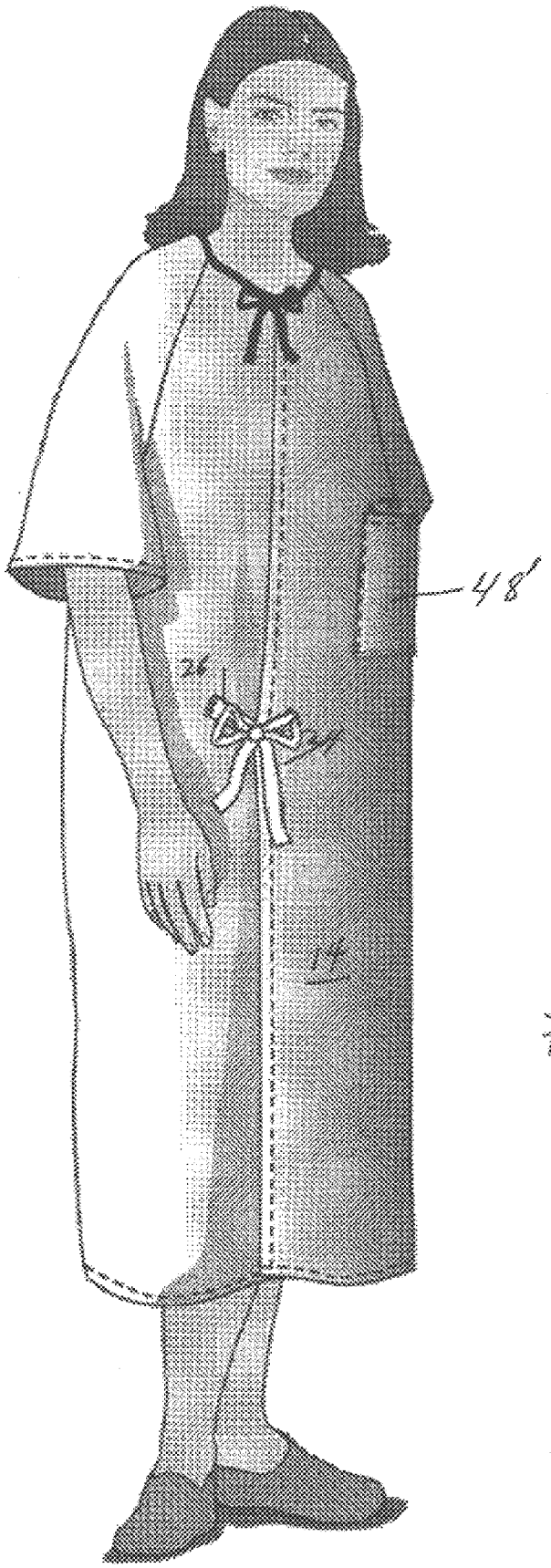
FIG. 4 is a front perspective view of another embodiment of this invention.

The left side of the outside of the body portion 14 may be equipped with a conventional telemetry pocket 48. The telemetry pocket 48 is sized to accommodate the majority of patient monitors and, as shown in FIG. 4 is provided with a horizontal slot in the body (not seen) through which wire connections may be passed to the patient's body. In a preferred embodiment, the telemetry pocket may be formed by sewing a rectangular fabric 50 along three of its edges X, Y and the edge opposite edge X (as shown in FIG. 1), leaving the top edge not sewn, such that the fabric is attached to the body portion 14. Thus, the top wall and the body portion 14 form a top opening 49 that allows for insertion of patient monitors (not shown) into the telemetry pocket 48.

The gown 10 may be made of fabrics conventionally used for patient gowns, such as, a combination of polyester and cotton, polyester alone or cotton alone. The material of the gown in not critical, and other fabrics may be used. The gown may be manufactured in different sizes. The gown may be worn by children, women and men. The gown should be appropriately sized in length, preferably to extend to the thighs of the patient. The gown should be appropriate sized in width, preferably to provide an overlap of fabric when tied in front to provide for the modesty of the patient.

Figure 2:
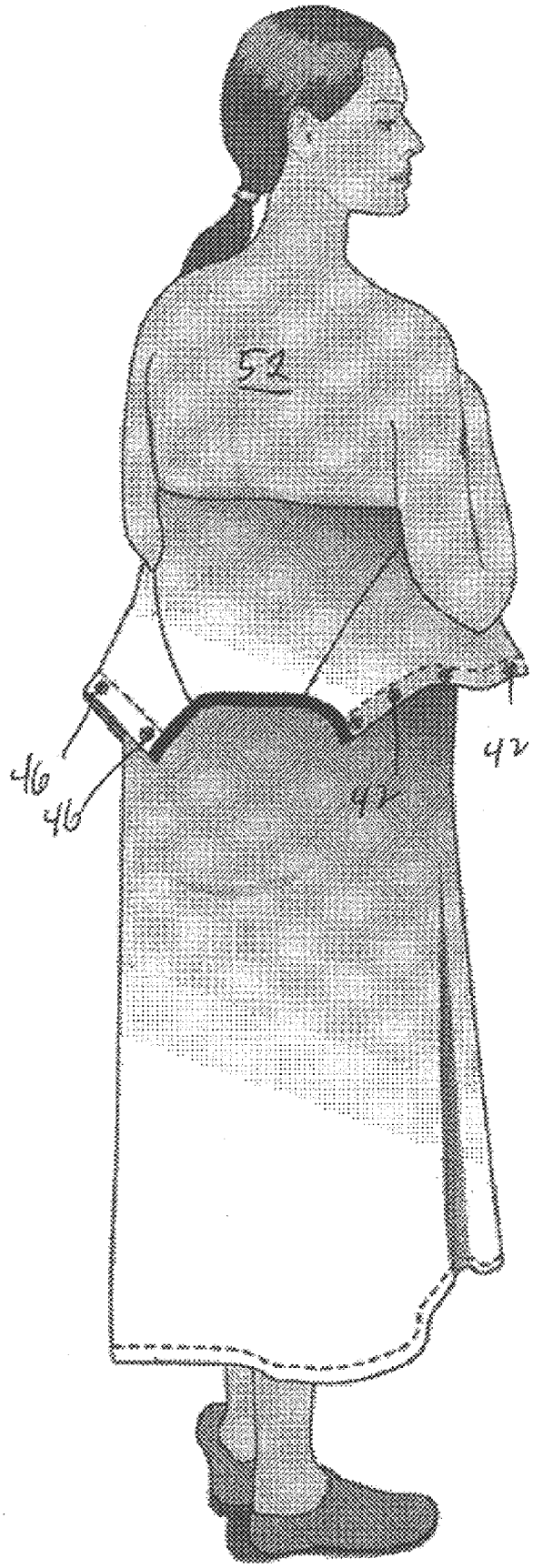
FIG. 2 is a rear perspective view of the embodiment of the present invention shown in FIG. 1.

In use, the invention provides modesty to the patient by opening and closing in the front by the patient tying the right lower tie 24 to the left lower tie 26 and also tying the upper ties 28 thus closing the front but always shielding the patient's posterior from view whether or not the ties are secured together. Medical personnel, such as doctors and nurses that need to examine and/or treat the patient may easily and conveniently unsnap the snap closures 40 and 46 and fold back the back of the sleeves 16 and 18 and the neck region of the body portion 14 (see FIG. 2) to examine and/or treat the patient's posterior neck, shoulders, arms and back, including but not limited to the thoracic area 52 of the back. Closing of the front provides the further advantage of eliminating the need for the patient to wear a bathrobe when walking in the hospital corridors. Since the posterior of the patient is not accessible to view in the gown 10, a bathrobe is not required for purposes of modesty.

The gown 10 is multi-purpose, tying in front for modesty and self-dressing, having a telemetry pocket accommodating for medical devices and providing for opening and closing of the sleeves to provide for convenient medical examination and procedures.

FIG. 4 is a perspective view of another embodiment of this invention in which an instrument pocket 48' is located in the front of a front closing hospital gown. The other parts of the hospital gown of FIG. 4 is identical to FIG. 1 except that the sleeves are closed. As stated, the prior art only has had front instrument pockets only with rear closing hospital gowns because front closing gowns were only used for exams and did not lend themselves to be made with an extra instrument pocket. To the inventor's knowledge, there is no prior art showing or suggesting a front instrument pocket with a front closing gown.

Having described this invention with regard to specific embodiments, it is to be understood that the description is not meant as a limitation since further modifications and variations may be apparent or may suggest themselves to those skilled in the art. It is intended that the present application cover all such modifications and variations as fall within the scope of the appended claims.

I claim:

1. A multi-purpose modesty gown for a patient comprising front and rear portions, said front and rear portions being at least long enough to cover the behind of the wearer, a body portion formed of said front and rear portions wrapped around the rear and open at the front of the patient, said body portion continuously closed at the rear of the patient to cover the rear of the patient, said gown further comprising left and right sleeves attached to said body portion, a front closure attached to close the front of said gown and a shoulder closure attached to said left and right sleeves allowing said sleeves to be selectively opened or closed to permit access to the rear of the patient, said front and rear portions having top edges, said front portion having a center of said top edge, said center being lower than the top edge of the rear portion so that the opening of the front portion is lower than the rear portion, whereby the front and rear portions are not reversible, said gown further comprising a telemetry pocket in said front portion permitting medical instruments to pass through the gown.

2. The multi-purpose gown of claim 1, further comprising a telemetry pocket attached to the front of said gown.

3. The multi-purpose gown of claim 1, wherein said front closure comprises a plurality of ties.

4. The multi-purpose gown of claim 1, wherein said shoulder closure comprises snaps.

5. The multi-purpose gown of claim 3, wherein said shoulder closure comprises snaps.

6. The multi-purpose gown of claim 2, wherein said front closure comprises a plurality of ties.

7. The multi-purpose gown of claim 2, wherein said shoulder closure comprises snaps.

8. The multi-purpose gown of claim 6, wherein said shoulder closure comprises snaps.

9. The multi-purpose gown of claim 1, wherein said front portion has a V center opening at its top edge.

10. The multi-purpose gown of claim 9, wherein said front closure comprises a plurality of ties.

11. The multi-purpose gown of claim 9, wherein said shoulder closure comprises snaps.

12. The multi-purpose gown of claim 11 wherein said shoulder closure comprises snaps.

13. The multi-purpose gown of claim 11 wherein said front and rear portions extend at least to the knees of the wearer.

* * * * *